US006866561B2

(12) United States Patent
Andrews

(10) Patent No.: US 6,866,561 B2
(45) Date of Patent: Mar. 15, 2005

(54) DECORATIVE BAT

(75) Inventor: Edward Andrews, Burbank, CA (US)

(73) Assignee: Anodizing Industries, Inc., Los Angeles, CA (US)

( * ) Notice: Subject to any disclaimer, the term of this patent is extended or adjusted under 35 U.S.C. 154(b) by 0 days.

(21) Appl. No.: 10/405,205

(22) Filed: Apr. 1, 2003

(65) Prior Publication Data

US 2004/0194521 A1 Oct. 7, 2004

(51) Int. Cl.[7] ..... B24B 1/00

(52) U.S. Cl. ..... 451/29; 451/38; 451/75; 451/80

(58) Field of Search ..... 451/29, 30, 31, 451/38, 445, 75, 80; 427/259, 264, 266; 72/53

(56) References Cited

U.S. PATENT DOCUMENTS 3,267,621 A * 8/1966 Meyers et al. ..... 451/31
3,535,758 A * 10/1970 Hoet ..... 445/49
4,133,919 A * 1/1979 Parsons ..... 427/259
4,199,358 A * 4/1980 Parsons ..... 430/308
4,801,490 A * 1/1989 Schuette ..... 428/211.1
5,831,641 A 11/1998 Carlson
5,833,516 A * 11/1998 De Haas et al. ..... 451/29
6,287,221 B1 9/2001 Pino

* cited by examiner

*Primary Examiner*—Dung Van Nguyen

(57) ABSTRACT

A method and apparatus for producing a highly attractive, decorative baseball bat. The apparatus of the invention enables the manufacture of decorative baseball bats that exhibit a wide variety of attractive designs. More particularly, the apparatus includes a uniquely configured, inexpensive masking member that can be slipped over the barrel of the bat so as to make selective portions of the baseball bat during the sandblasting step of the method of the invention.

7 Claims, 5 Drawing Sheets

DECORATIVE BAT

BACKGROUND OF THE INVENTION

1. Field of the Invention

The present invention relates generally to methods and apparatus for providing decorative designs on the surfaces of three-dimensional objects. More particularly, the invention concerns a novel method and apparatus for producing a decorative baseball bat by novel sandblasting and anodizing processes.

2. Discussion of the Prior Art

Baseball, both amateur and professional has long been popular in America and other countries such as Japan. Baseball fans enjoy not only watching the baseball game, but also partake of various types of refreshments sold during the baseball game. Additionally, many fans commemorate their attendance at a baseball game by buying souvenirs including souvenir baseball bats. Accordingly, decorative baseball bats have been sold in baseball parks for many years. Typically, these souvenir baseball bats are decorated with various types of team logos and other decorative art and are manufactured using either silk screen printing, foil stamping and like techniques. These types of decorative baseball bats are also sold in sporting goods stores and similar retail outlets.

One popular prior art souvenir baseball bat has a baseball player's image formed thereon. The image is transferred onto the bat by means of an ink-jet process that sprays the image onto the bat using colored ink. A somewhat similar prior art process is disclosed in U.S. Pat. No. 5,831,641 issued to Carlson. The Carlson patent discloses a method and apparatus for imprinting high quality images on non-planar surfaces, including the surfaces of various types of three-dimensional articles, such as baseball bats, formed from a number of different types of materials. In accordance with a Carlson method, the non-planar surfaces of the three-dimensional articles are printed using a uniquely modified ink jet image transfer technique. The apparatus disclosed by Carlson includes a modified ink jet plotter coupled with an article positioning apparatus which functions to automatically maintain the surface of the article to be printed within a plane substantially parallel to and slightly spaced apart from the plane within which the ink jet nozzles of the ink jet plotter reside.

U.S. Pat. No. 6,287,221 issued to Pino discloses a baseball bat article that includes a glossy finish coating material and an image-carrying transfer element. The baseball bat has a grip portion, a barrel portion and an intermediate portion interposed between the grip portion and the barrel portion. The glossy finish coating material is applied to the baseball bat to form a glossy finish along the bat length. The image-carrying transfer element is fabricated from a transparent sheet material.

As will be better understood from the description, which follows, the method and apparatus of the present invention enables the simple and inexpensive manufacture of an attractive decorative bat using sandblasting and conventional anodizing processes.

SUMMARY OF THE INVENTION

It is an object of the present invention to provide a method and apparatus for producing a highly attractive, decorative baseball bat that is simple and inexpensive.

Another object of the present invention is to provide a method and apparatus of the aforementioned character, which enables the manufacture of decorative baseball bats that exhibit a wide variety of attractive designs.

Another object of the invention is to provide an apparatus for producing a decorative baseball bat that includes a uniquely configured, inexpensive masking member that can be slipped over the barrel of the bat so as to mask selective portions of the baseball bat during the sandblasting step of the method of the invention.

Another object of the invention is to provide an apparatus for producing various types of attractive designs on non-planar surfaces, which is simple to use, is reliable in operation and requires minimum maintenance.

By way of summary, the method of one form of the present invention comprises the steps of covering at least a portion of the baseball bat with a masking member having a plurality of openings formed therein to form a processing subassembly; controllably rotating the processing subassembly; directing a stream of abrasive particles toward the rotating processing subassembly in a manner to permit the abrasive particles to pass through the openings in the masking member and to impinge upon the exposed portions of the baseball bat to form an abraded baseball bat; and then anodizing the abraded baseball bat.

Other objects and advantages of the invention will become apparent from the following description of the embodiments taken in conjunction with the accompanying drawings.

BRIEF DESCRIPTION OF THE DRAWINGS

FIG. 3A illustrates the step of placing the masking member over the baseball bat to be decorated. FIG. 3B illustrates the subassembly made up of the bat and the masking member. FIG. 3C illustrates the step of sandblasting the assembly made up of the masking member and the bat. FIG. 3E illustrate the appearance of the baseball bat after having been sandblasted and FIG. 3-D illustrates the anodizing step of the method of the invention.

DESCRIPTION OF THE INVENTION

Figure 1:
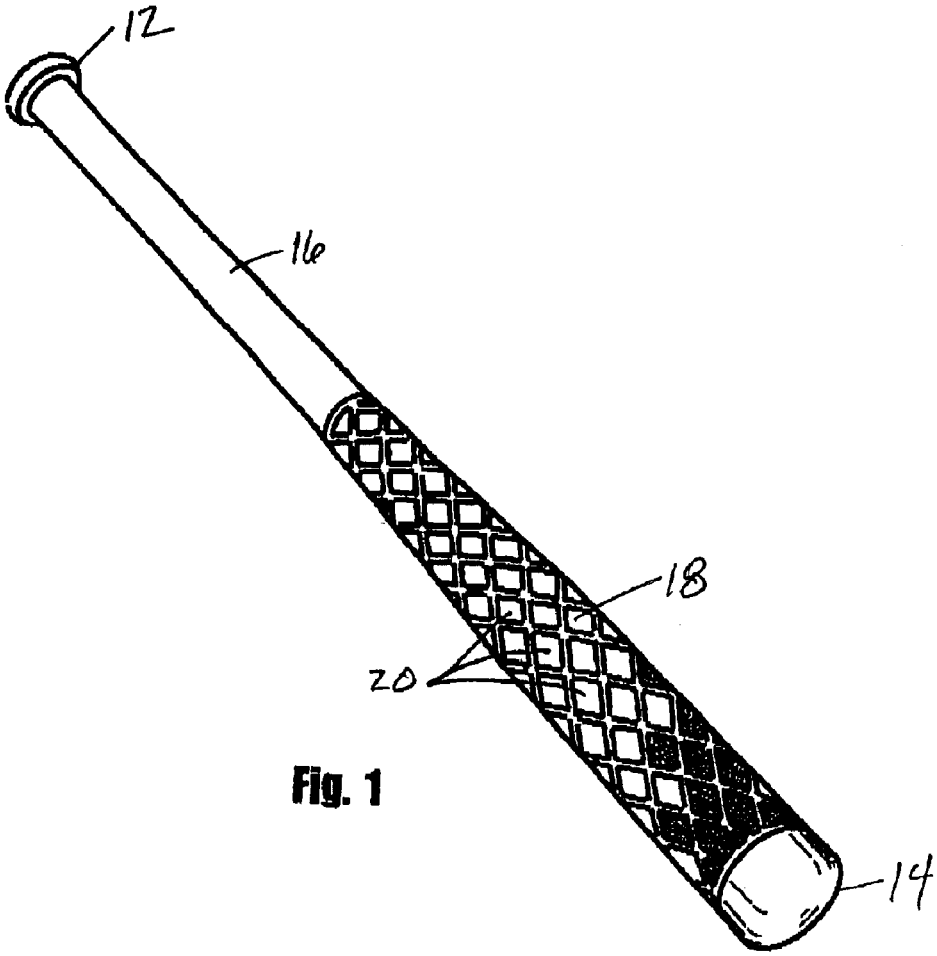
FIG. 1 is a generally perspective view of one form of the decorative baseball bat of the present invention.

Referring of the drawings and particularly to FIG. 1, one form of the decorative baseball bat of the present invention is there shown. The decorative baseball bat has first and second ends 12 and 14 respectively. Disposed intermediate ends 12 and 14 is a handle portion 16 and a barrel portion 18. In the present form of the invention the barrel portion 18 is provided with a decorative design that comprises a multiplicity of generally diamond shaped elements 20.

Figure 2:
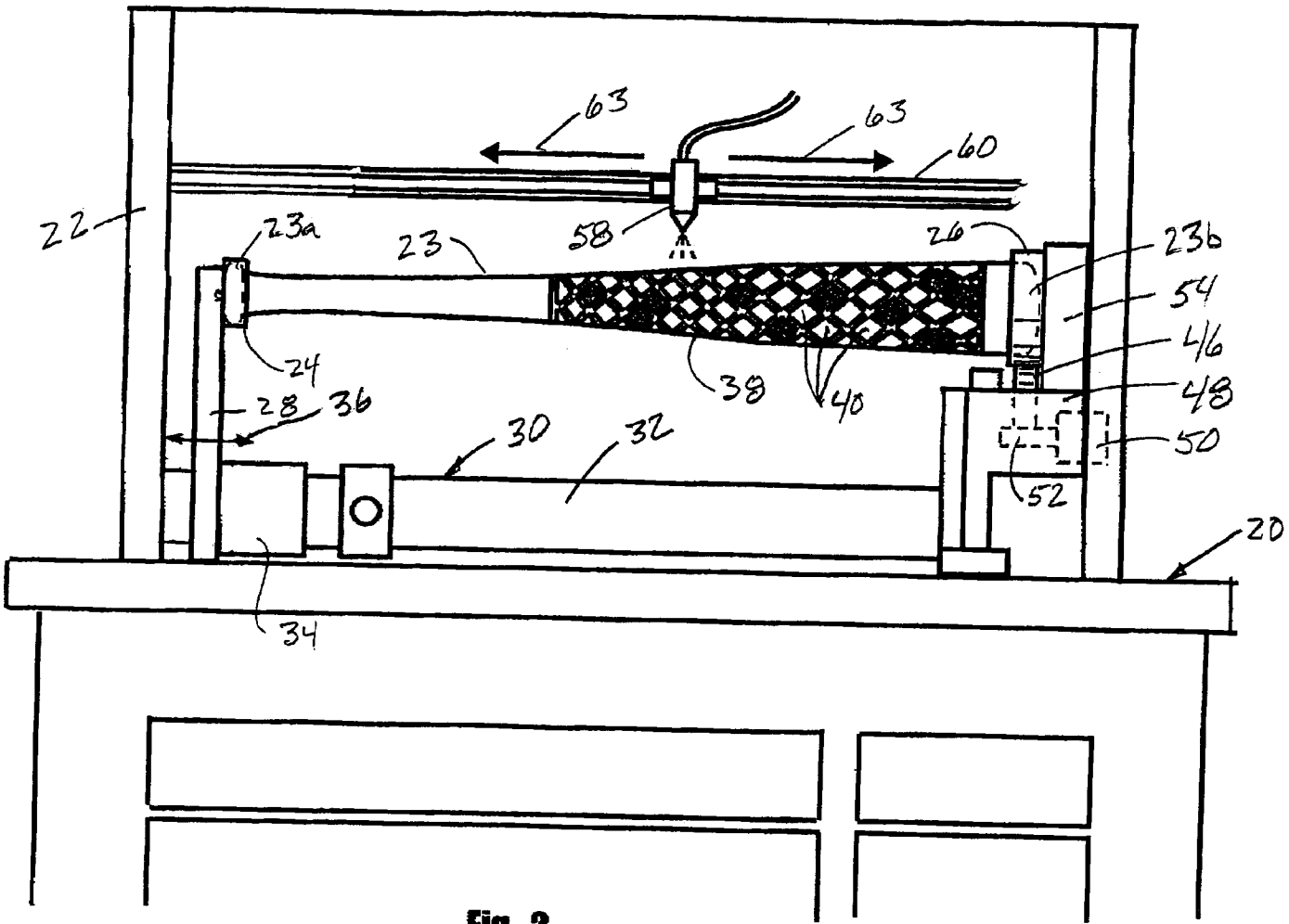
FIG. 2 is a front view of one form of the apparatus of the present invention for producing the decorative baseball bat shown in FIG. 1.

Turning to FIG. 2, one form of the apparatus of the invention for producing the decorative bat shown in FIG. 1 can be seen to comprise a supporting base 20 and an upstanding supporting frame 22 carried by base 20. Connected to frame 22 are gripping means for gripping a baseball bat 23. The gripping means here comprises a first generally cup shaped member 24 for gripping the first end 23*a* of the baseball bat and a second, larger diameter, generally cup-shaped member 26 for gripping the second end 23*b* of the baseball bat. Cup-shaped member 24 is rotatably connected to a vertical support member 28, which, in turn, is connected to a slide assembly generally designated in FIG. 2 by the numeral 30. Slide assembly 30 includes a generally horizontally extending slide bar 32 to which a slide collar 34 is slidably connected. As indicated in FIG. 2, slide collar 34 is connected to vertical support member 28 so that the vertical support member, along with cup 24, can be moved forwardly and rearwardly in the direction of the arrow 36 of FIG. 2. With the construction thus described, the apparatus can accept bats of varying length and the vertical support member 28 can be moved rearwardly, or to the left, from the bat supporting position shown in FIG. 2 to a retracted position to permit the convenient insertion of the ends of the bat into cups 24 and 26.

Also forming a part of the apparatus of the invention is a generally cylindrically shaped masking member 38 that is adapted to circumscribe at least a portion of the baseball bat 23 in the manner shown in FIG. 2 of the drawings. For a purpose presently to be described, masking member 38 is provided with a plurality of openings 40. It is to be understood that while openings 40 are shown in FIG. 2 as being generally triangular in shape, the openings can be of various configurations such as the oval shaped openings 42 shown in the alternate form of the masking 44 member illustrated in FIG. 3A of the drawings.

Referring once again to FIG. 2, the apparatus of the present form of the invention also includes rotating means that are operably associated with the gripping means for controllably rotating the gripping means and the assemblage made up of the baseball bat 23 and the masking member 38. The rotating means here comprise a drive wheel 46 that is rotatably connected to a support assembly 48 that is mounted on base 22 and motor means, shown here as an electric motor 50 that is supported by support assembly 48 in the manner shown in FIG. 2. Electric motor 50 includes a drive shaft 52 that drivably engages cup 14, which is rotatably connected to a support member 54. Support member 54 is, in turn, carried by support assembly 48 and is positioned so that when motor 50 is energized drive shaft 52 will controllably rotate drive wheel 46 which, in turn, will controllably rotate the assemblage made up of cup 26, baseball bat 23 and supporting cup 24.

Forming an important aspect of the apparatus of the invention is abrading means for directing a stream of abrasive particles toward the baseball bat 23 to form an abraded baseball bat. This important abrading means is supported by upstanding frame 22 in the manner shown in FIG. 2. The abrading means, which is disposed proximate generally cylindrically shaped masking member 38, here comprises a conventional sandblasting apparatus that includes a nozzle 58 which is mounted on a track 60 that is supported by frame 22. As indicated by the arrows 63 in FIG. 2, sandblasting nozzle 58 is movable along track 60 and longitudinally of masking member 48. In a conventional manner the sandblasting nozzle functions to controllably direct a stream of abrasive products particles through the openings 40 formed in the masking member 38 and toward the baseball 23 to abrade or roughen the exposed areas of the bat. A suitable sandblasting apparatus is commercially available from Envirosystems, LLC of Tucson, Ariz.

Figure 3A:
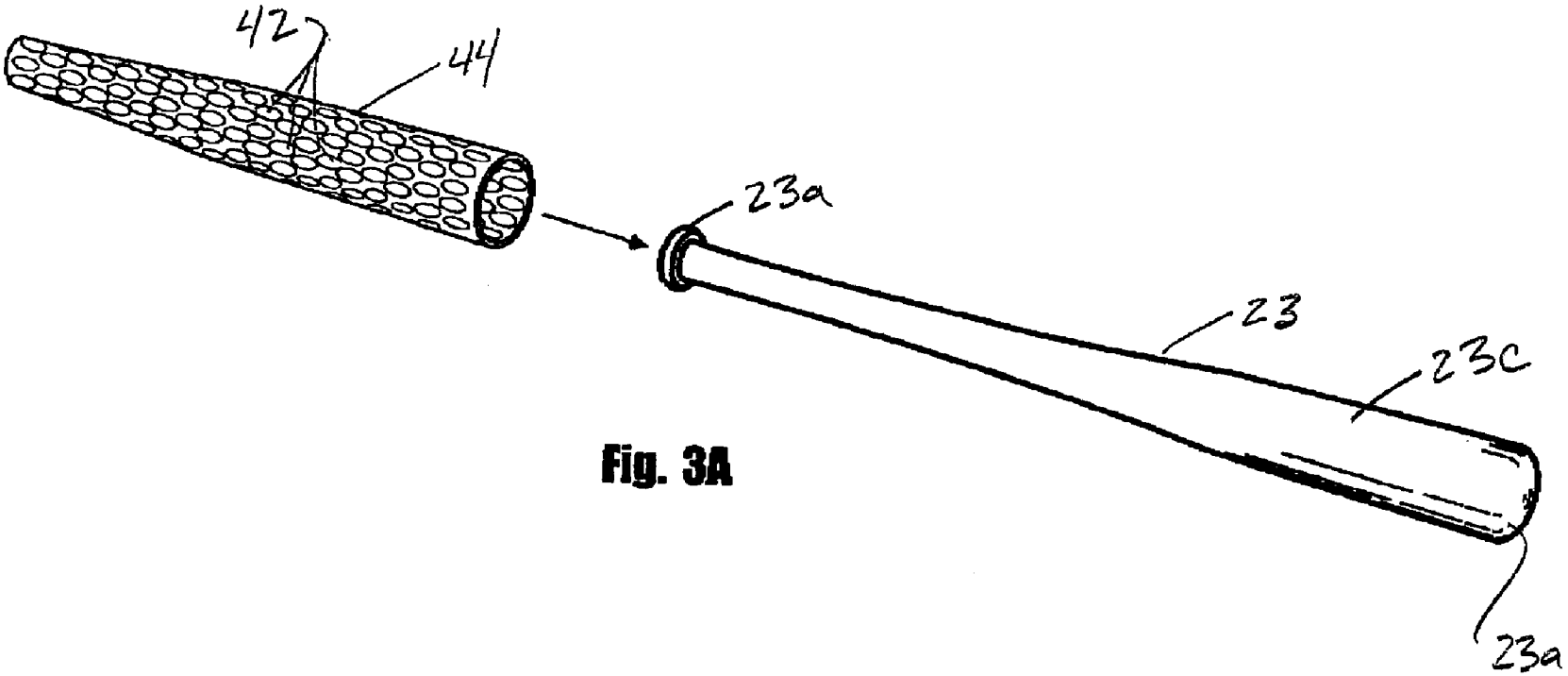
FIGS. 3A, 3B, 3C, 3D, and 3E when considered together illustrate the various steps in accomplishing one form of the method of the invention. More particularly.
Figure 3B:
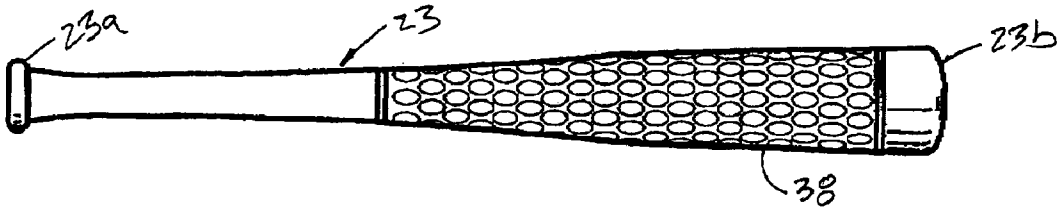
Figure 3C:
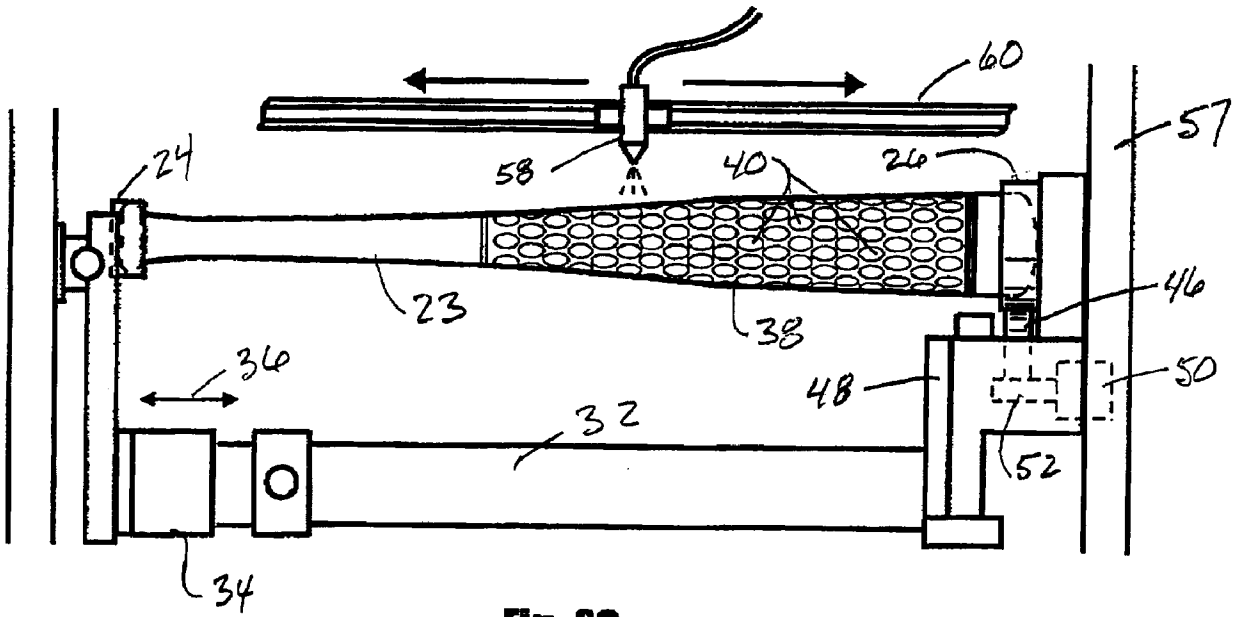
Figure 3E:
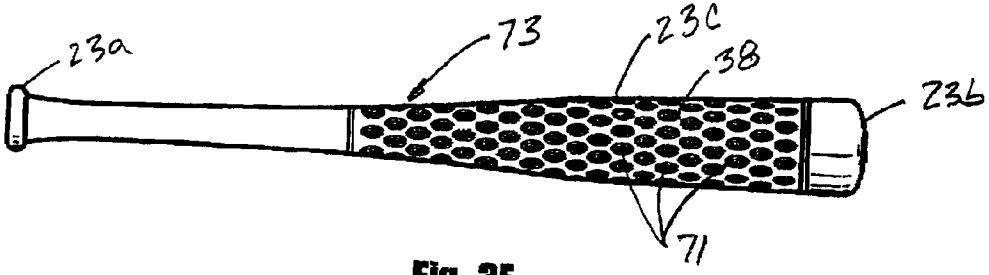
Figure 3D:
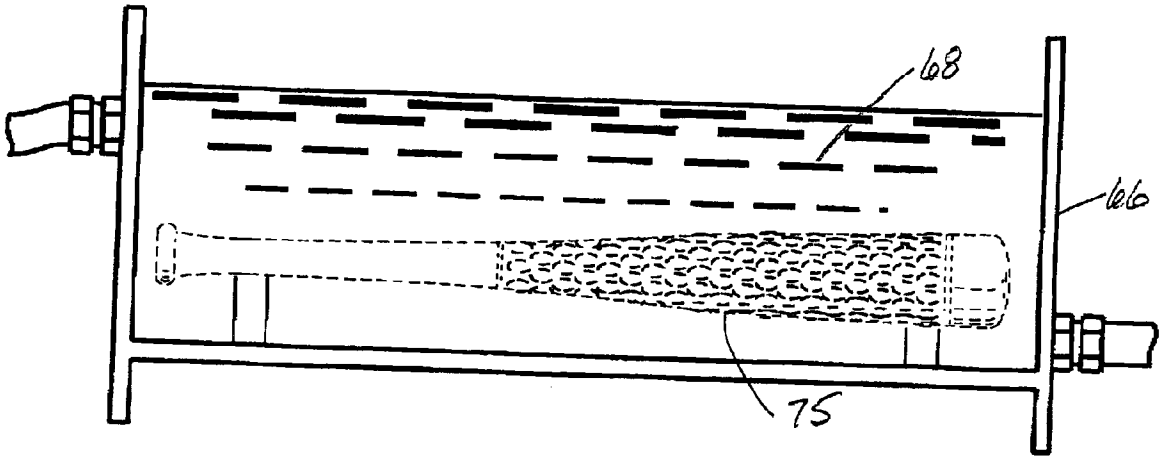

As depicted in FIG. 3D of the drawings, the apparatus of the invention also includes anodizing means for anodizing the abraded baseball bat. This anodizing means here includes an anodizing tank 66 of conventional construction for containing an anodizing solution 68. As will be discussed in greater detail hereinafter, anodizing involves the formation of an oxide surface on nonferrous metal by electrochemical means. During the oxidizing process, the surface oxide films supplement the natural oxide, which occurs in very thin layers on certain metals and results in a significant increase in their corrosion resistance. Aluminum, in particular, forms a thin tenaciously adhering oxide film, which provides both an attractive finish and an excellent barrier against corrosion.

Considering next one form of the method of the invention for making a decorative bat of the character shown in FIG. 1, reference should be made to FIGS. 3A, 3B, 3C, 3D and 3E. As depicted in FIG. 3A, the first step in the form of the method of the invention illustrated in the drawings is to slip a masking member, such as masking member 44, which is generally cylindrical in shape, over the handle portion 23*a* of the bat and then over the barrel portion 23*c* to form the assemblage illustrated in FIG. 3B. Next, the assemblage made up of the bat 23 and the masking member 38 is positioned within the previously described apparatus of the invention so that the bat is clamped between rotatably mounted caps 24 and 26. With the assemblage positioned in the manner shown in FIG. 3C of the drawings, motor 50 is energized to cause controlled rotation of the assemblage relative to the abrading means of the invention. As the assembly is rotated, a stream of abrasive particles is directed from the reciprocally movable sandblasting nozzle 58 toward the masking member in a manner to permit the abrasive particles to pass through the generally oval shaped openings 40 in the masking member and to impinge upon the exposed portions 71 of the baseball bat form an abraded baseball bat assemblage 73 of the character shown in FIG. 3E.

Following the removal of masking member 38 from the baseball bat, the abraded baseball bat 75 is transported to the anodizing station and is placed in the conventional, readily commercially available anodizing tank 66 in the manner illustrated in FIG. 3D. Suitable anodizing equipment is commercially available from the N>Tec Company of Bensalew, Pa. The process used to anodize the abraded baseball bat assembly 73 is well understood by those skilled in the art and makes use of electrolytes 68 such as chromic acid, sulfuric acid and oxalate acid. Other electrolytes such as borates, citrates, carbonates, sulfuric acid and phosphoric acid can also be used in certain applications. Anodizing of aluminum involves the electrochemical conversion of the surface to aluminum oxide. The aluminum metal serves as the anode and the oxygen is provided by the electrolytic disassociation of water.

The finished bat produced by the method of the invention can be of various colors and can have various designs, such as the oval and triangular shaped designs shown in the drawings. However it is to be understood that a wide variety of other designs can be produced by simply using a masking member of a different configuration.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a decorative metal baseball bat having a barrel portion comprising the steps of:

(a) circumscribing at least a portion of the barrel portion of the baseball bat with a generally cylindrically shaped masking member having a plurality of openings formed therein to form a processing subassembly;

(b) controllably rotating said processing subassembly;

(c) directing a stream of abrasive particles toward said rotating processing subassembly in a manner to permit the abrasive particles to pass through the openings in said masking member and to impinge upon portions of the baseball bat to form an abraded baseball bat; and (d) anodizing said abraded baseball bat.

2. The method as defined in claim 1 in which the baseball bat is constructed of aluminum.

3. The method as defined in claim 1 in which said masking member has a plurality of triangularly shaped openings formed therein.

4. The method as defined in claim 1 in which said masking member has a plurality of oval shaped openings formed therein.

5. An apparatus for making a decorative baseball bat having first and second ends comprising:

(a) abase;

(b) gripping means mounted on said base for gripping the baseball bat, said gripping means comprising a first, generally cup-shaped member for gripping the first end of the baseball bat and a second generally cup-shaped member for gripping the second end of the baseball bat;

(c) a generally cylindrically-shaped masking member circumscribing at least a portion of the baseball bat, said masking member having a plurality of openings therein;

(d) rotating means operably associated with said gripping means for controllably rotating said gripping means and the baseball bat; and (e) abrading means disposed proximate said generally cylindrically shaped masking member for directing a stream of abrasive product particles toward the baseball bat to form an abraded baseball bat.

6. The apparatus as defined in claim 5 in which said rotating means comprises motor means carried by said base for controllably rotating said first generally cup shaped member.

7. The apparatus as defined in claim 6 in which said sandblasting means comprises a sandblasting nozzle and in which said apparatus further includes means for controllably moving said sandblasting nozzle relative to said masking member.

* * * * *